US006216866B1

(12) United States Patent
Schoenberg

(10) Patent No.: US 6,216,866 B1
(45) Date of Patent: Apr. 17, 2001

(54) DISPLAY PACKAGE FOR ELECTRONIC DEVICES WITH DISPLAYS

(76) Inventor: Patricia A. Schoenberg, 6181 N. Prescott, Chicago, IL (US) 60646

( * ) Notice: Subject to any disclaimer, the term of this patent is extended or adjusted under 35 U.S.C. 154(b) by 0 days.

(21) Appl. No.: 09/442,619

(22) Filed: Nov. 17, 1999

(51) Int. Cl.[7] ..... B65D 85/38
(52) U.S. Cl. ..... 206/320; 206/305; 206/461
(58) Field of Search ..... 206/305, 320, 206/576, 471, 461; 150/165; 312/208.3

(56) References Cited

U.S. PATENT DOCUMENTS

| | | | | |
|---|---|---|---|---|
| 2,492,262 | * | 12/1949 | Boyden et al. | 150/165 |
| 4,075,702 | * | 2/1978 | Davies | 206/305 X |
| 4,165,805 | | 8/1979 | Fethke . | |
| 4,837,590 | * | 6/1989 | Spraque | 206/305 X |
| 5,092,459 | * | 3/1992 | Uljanic et al. | 206/320 |
| 5,242,056 | * | 9/1993 | Zia et al. | 206/576 |
| 5,279,417 | | 1/1994 | Scaton . | |
| 5,325,970 | * | 7/1994 | Dillon et al. | 206/576 |
| 5,392,920 | * | 2/1995 | Prete et al. | 206/320 X |
| 5,435,447 | | 7/1995 | Weatherford . | |
| 5,499,713 | * | 3/1996 | Huffer | 206/305 |
| 5,678,695 | * | 10/1997 | Ridgeway | 206/305 X |
| 5,682,993 | * | 11/1997 | Song | 206/320 |
| 5,775,516 | | 7/1998 | McCumber . | |
| 5,812,188 | * | 9/1998 | Adair | 206/320 X |
| 5,931,297 | * | 8/1999 | Weill et al. | 206/320 |

OTHER PUBLICATIONS

Declaration of Michael A. Carrillo, attached hereto.

* cited by examiner

*Primary Examiner*—Bryon P. Gehman
(74) *Attorney, Agent, or Firm*—Robert E. Browne; Michael A. Carrillo

(57) ABSTRACT

A new and useful package and method capable of and for applying the package to an electronic device having a base and a display member pivotally connected to the base. The package includes a first panel overlying the working surface of the electronic device which encases at least a portion of the base of the electronic device, and an opposed second panel underlying the said electronic device which also encases at least a portion of the base of the electronic device. Moreover, a first aperture is disposed on the first panel near the display and dimensioned to allow the display to pivot relative to the base. A second aperture is also formed or cut on the first panel near the on and off buttons and dimensioned to allow the electronic device to be turned on and off without opening the package. The display may be manipulated without opening the package and while the electronic device remains secured within the packaging. Therefore, this invention eliminates the need for sellers of electronic devices with pivotal displays to provide unpackaged electronic devices as floor samples while still allowing prospective customers to manipulate and test the pivotal display of the electronic device within the package.

13 Claims, 6 Drawing Sheets

DISPLAY PACKAGE FOR ELECTRONIC DEVICES WITH DISPLAYS

BACKGROUND OF THE INVENTION

1. Field of the Invention

This invention generally relates to clam-shell or blister packaging (generally referred to as "packaging") for holding and displaying electronic devices with displays. More particularly, this invention relates to packaging for holding and displaying calculators or similar devices with movable displays or features and which allows prospective purchasers to move said display without removing the calculator from said packaging.

2. Description of the Prior Art

Clam-shell packaging is customarily used to mount small items of hardware or other products by utilizing two mating surfaces or shells that are shaped in the form of the product which is to be held. It is generally known in the art to hold these two moveable surfaces or shells together by mechanical or adhesive means. Additionally, the two shells may be manufactured for engagement using a variety of methods such as integral snap-over edges, snap-together elements or by using a clasp means.

Blister packaging can also be used to package and display small items of hardware or other products. Blister packaging functions by mounting the product on a display card. The product and the display card are then encapsulated by transparent, semi-flexible material such as polyvinyl chloride ("PVC") and the transparent, semi-flexible material is attached to the display card by heat and pressure-adhesive techniques. Blister packages which allow users to access moving parts have been described in several patents, such as U.S. Pat. No. 4,179,029 entitled "Blister Packages for Scissors, Pliers and Other Hand Tools," issued to Fethke et al. on Aug. 28, 1979, U.S. Pat. No. 4,165,805 entitled "Functional Blister Package for Snipper-Type Scissors," issued to Fethke et al. on Dec. 18, 1979, and U.S. Pat. No. 5,279,417 entitled "Package for Hand Tools," issued to Seaton on Jan. 18, 1994.

The '029 patent, the '805 patent and the '417 patent each show packaging which mounts and displays hand tools with two handles. Further, the packages are designed to allow the customer to operate the tool to some extent while it remains in the package. Although these patents disclose using blister packaging to mount products which have movable parts in a manner which allows the customer to operate the movable aspect of the product, none of these patents discloses a configuration capable of mounting and displaying an electronic device with a movable display where the display can be moved for viewing as if in use. Rather, each of the above patents include limitations for securing products having two pivotally connected arms, such as, scissors.

It is therefore an object of the present invention to provide a package which overcomes the problems associated with the prior art as applied to the display of small electronic devices.

SUMMARY OF THE INVENTION

In accordance with the present invention, a package for holding and displaying an electronic device having a base and a display member pivotally connected to said base, is described. The package includes a first panel overlying the working surface of the electronic device which encases at least a portion of the base of the electronic device, and an opposed second panel underlying the working surface of said electronic device which also encases at least a portion of the base of the electronic device. Moreover, a first aperture is formed or cut on the first panel near the display and dimensioned to allow the display member to pivot without contacting the first panel or the second panel. A second aperture is also formed or cut on the first panel near the on and off buttons and dimensioned to allow the electronic device to be turned on an off without opening the package. The display may be manipulated without opening the package and while the electronic device remains secured within the packaging. Therefore, this invention eliminates the need for sellers of electronic devices with pivotal displays to provide unpackaged electronic devices as floor samples while still allowing prospective customers to manipulate and test the pivotal display of the electronic device within the package.

The foregoing and other features and advantages of the present invention will be apparent from the following more detailed description of the invention.

DETAILED DESCRIPTION OF THE PREFERRED EMBODIMENT

While this invention is susceptible of embodiments in many different forms, there is herein described in detail, a preferred embodiment of the invention with the understanding that the present disclosure is to be considered as an exemplification of the principles of the invention and is not intended to limit the broad aspects of the invention to the embodiments illustrated herein.

Figure 1:
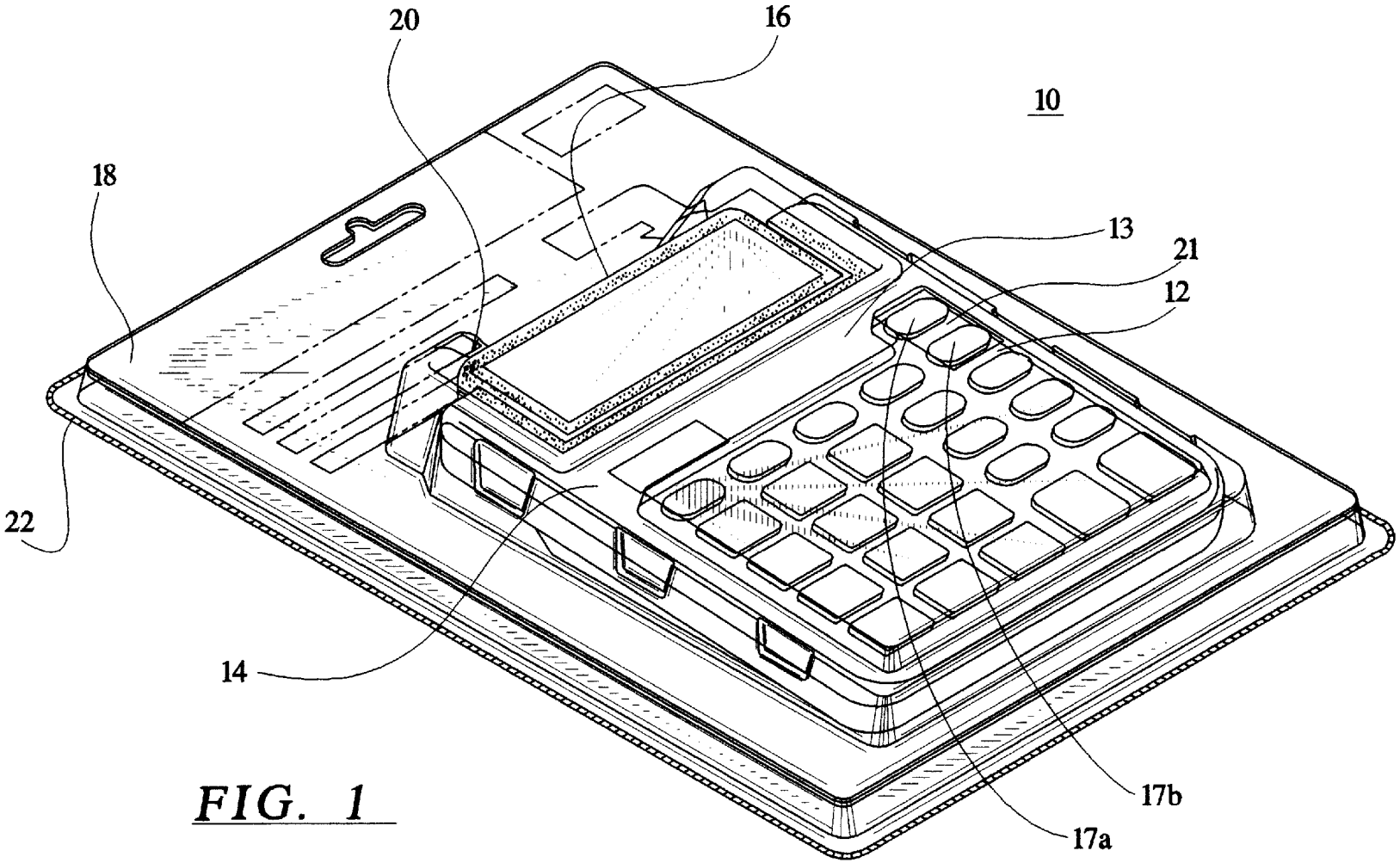
FIG. 1 is a perspective view of a packaging encasing a calculator with a movable display where the display is in a closed position.
Figure 2:
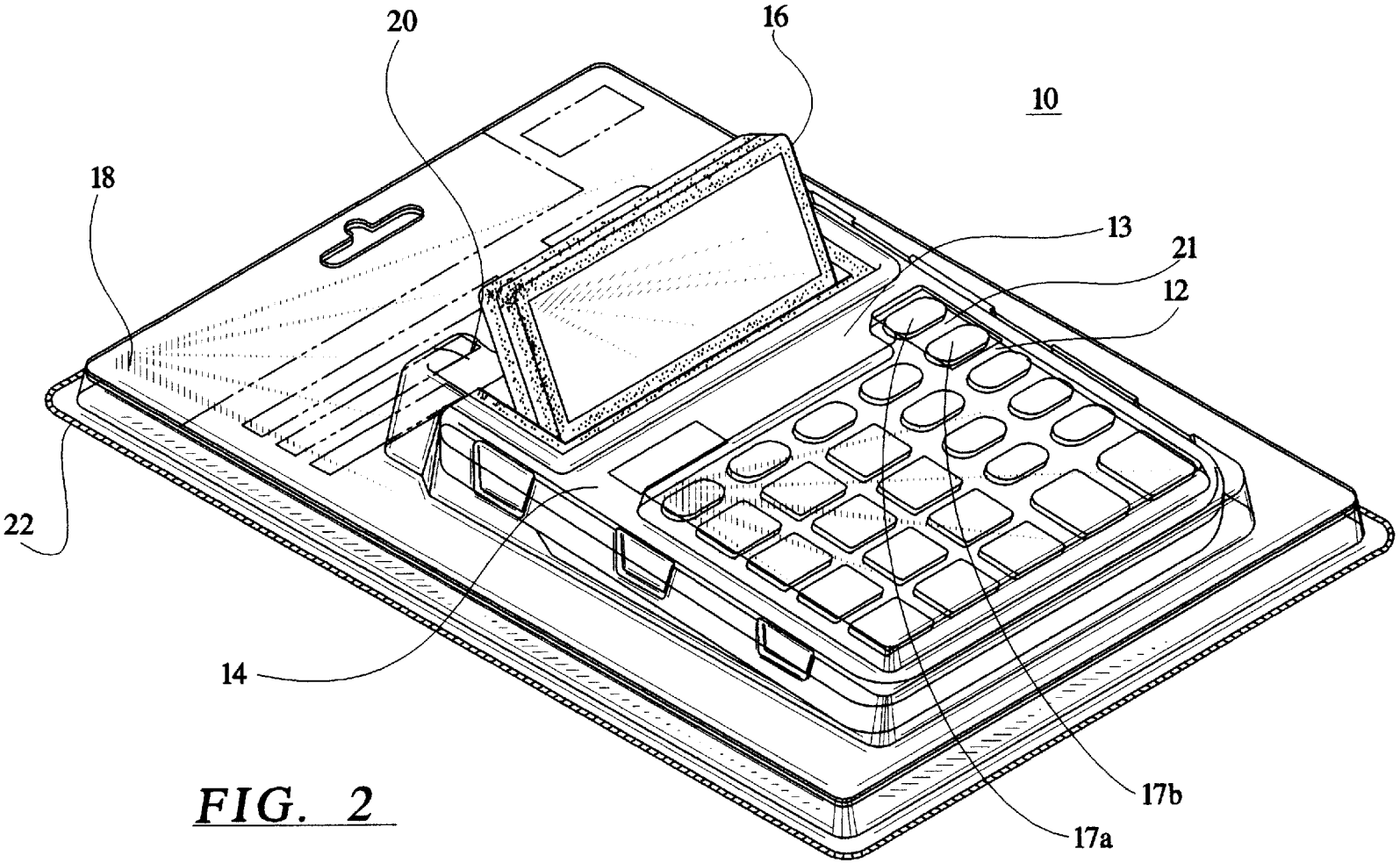
FIG. 2 is a perspective view of a packaging encasing a calculator with a movable display in an open position.
Figure 3:
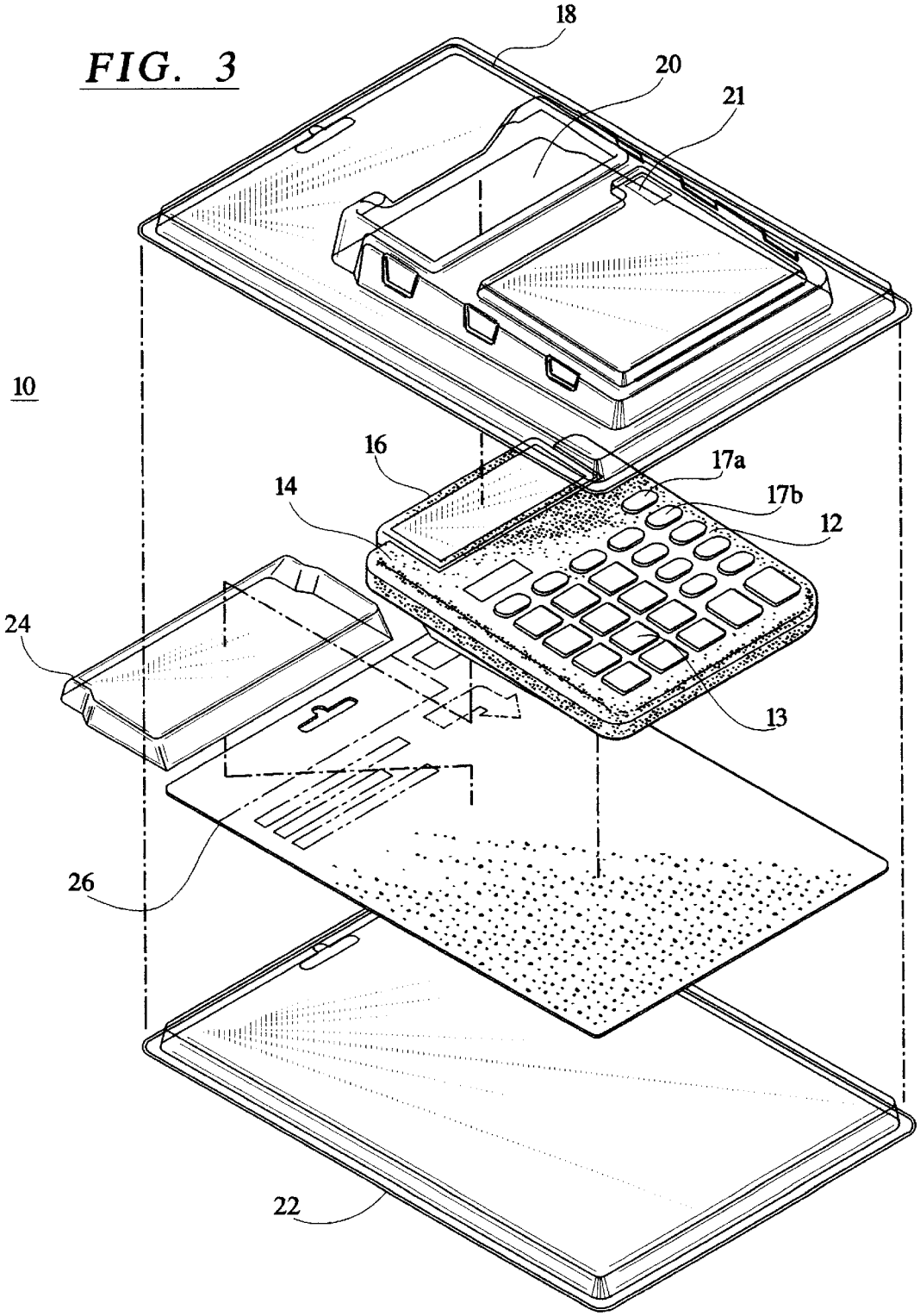
FIG. 3 is an exploded view of a packaging encasing a calculator with a movable display.

In the preferred embodiment and as exemplified in FIG. 1, there is disclosed a package 10, capable of displaying an electronic device 12, consisting of a base 14 and a movable display member 16, in a manner which allows prospective customers to move the display member 16 without removing the electronic device 12 from the package. The package 10 is comprised of a first panel 18 which is sized to overlay the working surface 13 of the electronic device 12 while also encasing a portion of the base 14 of the electronic device 12. The package 10 also includes a second panel 22 which is sized to underlay the base 14 of electronic device 12. As is known in the art, the first panel 18 and the second panel 22 form an integral package by joining edges of the first panel 18 and second panel 22. These panels 18, 22 can be connected by mechanical or adhesive means, such as, heat sealing or high frequency sealing, snap-over edges, clasp means, adhesives or taping. In addition, as exemplified in FIG. 2, the first panel 18 also includes a first aperture 20 proximate the location of the display member 16 and dimensioned to allow said display 16 to pivot without contacting the first panel 18 or the second panel 22. A second aperture 21 is also formed or cut on the first panel 18 near the on 17*a* and off 17*b* buttons and dimensioned to allow the electronic device 12 to be turned on without opening the package 10. Moreover, a third panel 24 may be placed between the first panel 18 and the second panel 22 to prevent said electronic device from moving relative to such panels. As shown in FIG. 3, the third panel 24 is smaller than the base of electronic device 12 and is beveled on one side. The base 14 also includes a beveled portion which interacts with the beveled portion of the third panel 24 to secure the electronic device 12 within the packaging 10. The third panel 24 can be made of cardboard, plastic or other material, and can be opaque or transparent. A fourth or mounting panel 28 may also be placed between the first panel 18 and second panel 22, and the electronic device 12 may be mounted on the fourth panel 26. The fourth panel 26 may be constructed of cardboard or plastic, and may be opaque or transparent. Text can be included on the fourth panel 26 in the form of advertisements or product descriptions.

Figure 4:
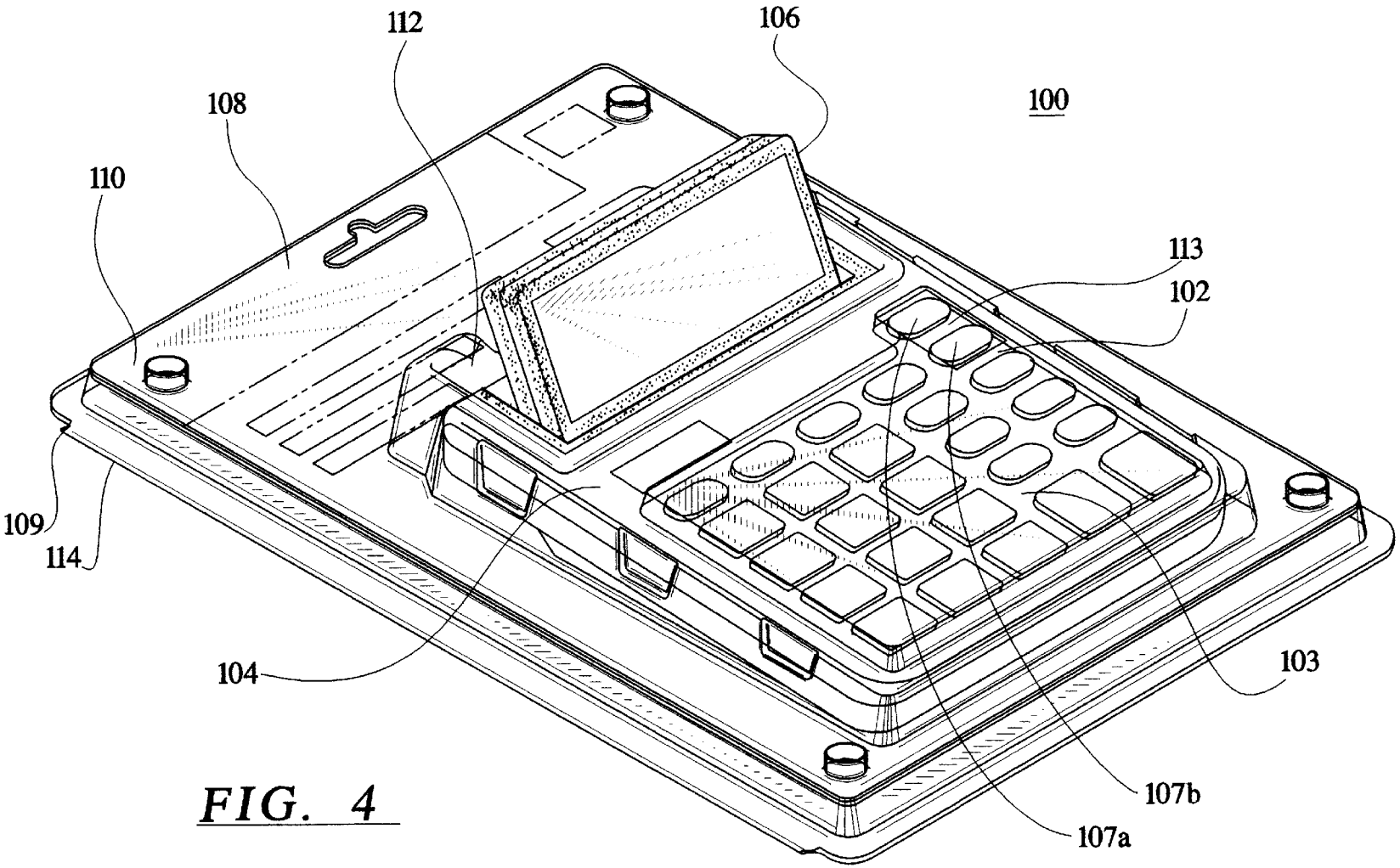
FIG. 4 is a perspective view of the second embodiment of the present invention where the packaging is in a closed position and where the display is in a open position.
Figure 5:
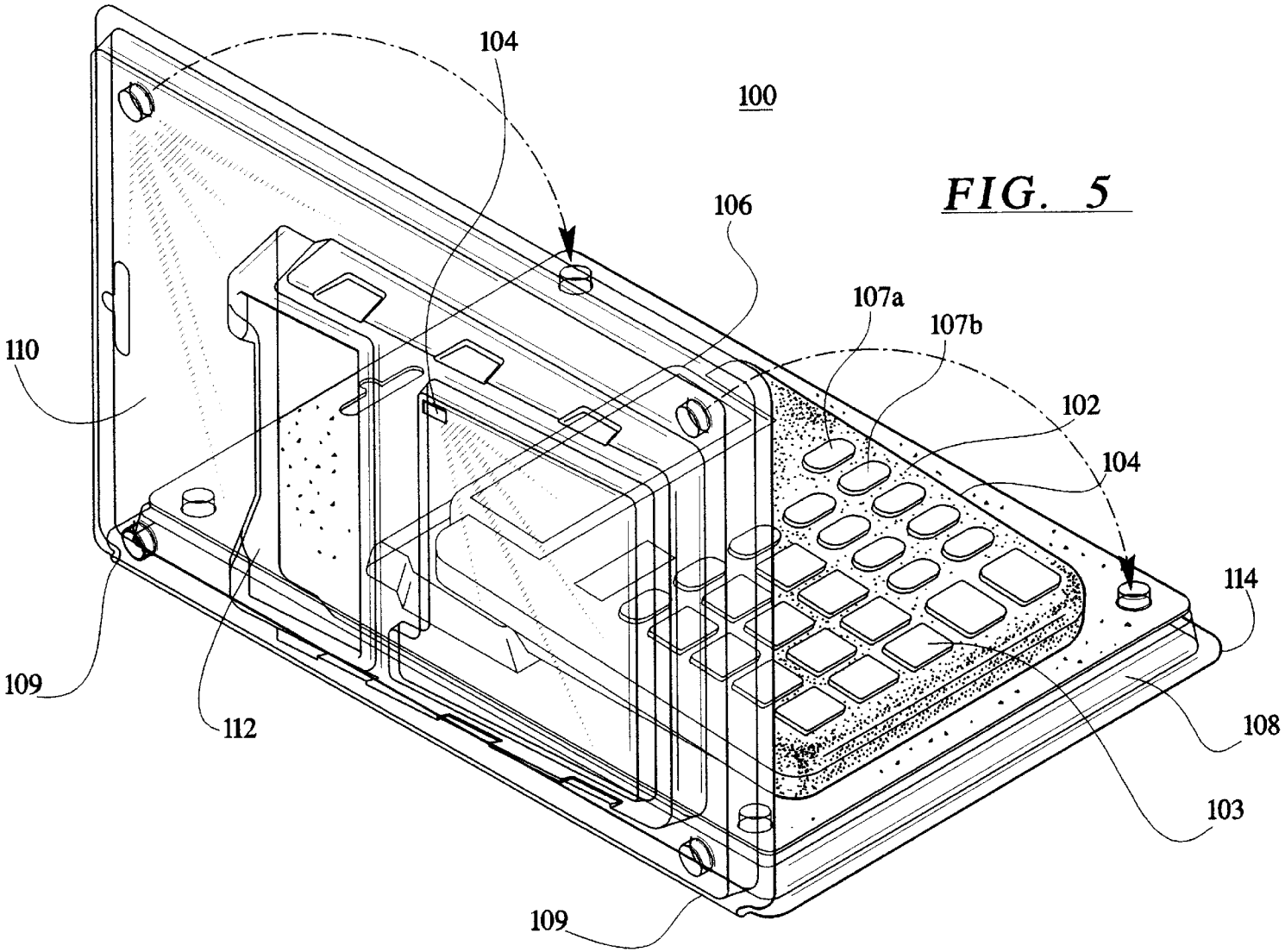
FIG. 5 is a perspective view of the second embodiment of the present invention where the packaging is in an open position and where the display is in an open position.
Figure 6:
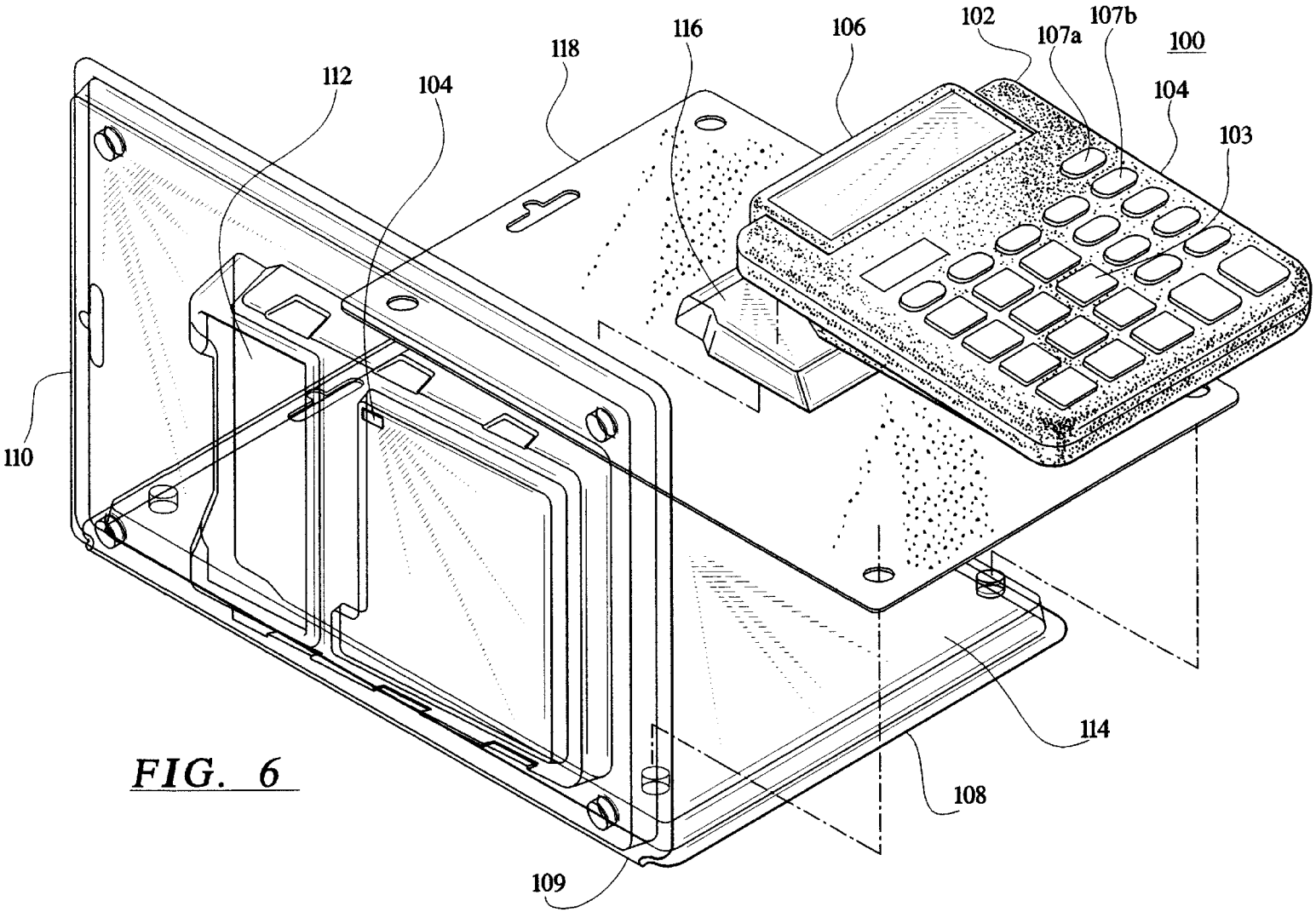
FIG. 6 is an exploded view of the second embodiment of the present invention encasing a calculator with a movable display where the display is in an open position.

FIG. 4 shows a second embodiment of the present invention which includes a package 100, capable of displaying an electronic device 102, consisting of a base 104 and a moveable display member 106, in a manner which allows prospective customers to move the display member 106 without removing the electronic device 102 from the package 100. The package 100 is comprised of a panel 108 with a first side 110 and a second side 114 where the first side 110 is integrally connected to the second side 114 by a fold 109 and where the first side 110 overlies a working surface 103 of the electronic device 102 and encases at least a portion of the base 104 of the electronic device 102. In addition, the package 100 can be folded to a closed position in a manner which allows the first side 110 to oppose the second side 114 and where the second side 114 underlies the working surface 103 of the electronic device 102 and encases at least a portion of the base 104 of the electronic device 102. The first panel 110 also includes a first aperture 112 which is disposed proximate to the location of the display member 106. The first aperture 112 is dimensioned to allow the display member 106 to pivot without contacting the first side 110 or the second side 114. A second aperture 113 is also formed or cut on the first panel 110 near the on 107*a* and off 107*b* buttons and dimensioned to allow the electronic device 102 to be turned on without opening the package 100. When the package 100 is in a closed position, the display member 106 may be manipulated without opening the package 100 and while the electronic device 102 is still secured within the package 100. As shown in FIG. 6, a spacer 116 may be placed between the first side 110 and the second side 114, so that with the package in a closed position, the combination of the spacer 116, the first side 110 and the second side 114 prevent the electronic device 102 from moving. The spacer 116 is smaller than the base of electronic device 102 and is beveled on one side. The base 104 also includes a beveled portion which interacts with the beveled portion of the spacer 116 to secure the electronic device 102 within the packaging 100. The spacer 116 may be opaque or transparent. The package 100 may also include an insert 118 placed between the first side 110 and the second side 114, when the package is in a closed position, and where the electronic device 102 can be mounted on the insert 118. The insert 118 may be made of cardboard or plastic, and may be opaque or transparent. Text can be included on the insert 118 in the form of advertisements or product descriptions. As shown in FIG. 6, the package 100 can also exist in an open position.

While the invention has been particularly shown and described with reference to a particular embodiment thereof, it will be understood by those skilled in the art that various changes in form and detail may be made therein without departing from the spirit and scope of the invention. The present example and embodiment, therefore, are to be considered in all respects as illustrative and not restrictive, and the invention is not to be limited to the details given herein.

I claim:

1. A package for holding and displaying an electronic device, said electronic device having a base, a display member, and an on button and an off button, said display member being pivotally connected to said base, said package comprising:

a first panel overlying a portion of the working surface of said electronic device and encasing at least a portion of said base of said electronic device;

a second panel underlying said electronic device and said second panel encasing at least a portion of said base of said electronic device;

a first aperture formed in said first panel proximate the location of said display member and dimensioned to allow said display member to pivot relative to said base whereby said display member may be manipulated without opening the package and while said electronic device remains secured within the package; and, a second aperture formed in said first panel near the on and off buttons and dimensioned to allow said electronic device to be turned on and off without opening the package.

2. The package described in claim 1, wherein said package also includes a third panel placed between the first panel and the second panel to prevent said electronic device from moving relative thereto.

3. The package described in claim 1, wherein the first panel and second panel are transparent.

4. The package described in claim 1, wherein said package also includes a mounting panel placed between the first panel and the second panel and where said electronic device is mounted on said mounting panel.

5. The package described in claim 4, wherein the mounting panel is made of cardboard.

6. The package described in claim 5, wherein the mounting panel includes text.

7. The package described in claim 1, wherein the first panel and the second panel are integrally formed on one side of the first panel and second panel, respectively.

8. A package for holding and displaying an electronic device, said electronic device having a base, a display member, and an on button and an off button, said display member being pivotally connected to said base, said package comprising:

a panel with a first side and a second side where the first side is integrally connected to the second side by a fold therebetween, where the first side overlies the working surface of said electronic device and encases at least a portion of the base of said electronic device and the package can be folded in a manner which allows the first side to oppose the second side and where the second side underlies the working surface of said electronic device and encases at least a portion of the base of said electronic device;

a first aperture disposed on said first side proximate the location of said display member and dimensioned to allow said display member to pivot without contacting the first side or the second side, where said display member may be manipulated without opening the package and while said electronic device is secured within the package; and a second aperture disposed on said first side near the on button and the off button and dimensioned to allow said electronic device to be turned on and off without opening the package.

9. The package described in claim 8, where said package also includes a spacer placed between the first side and the second side to prevent said electronic device from moving.

10. The package described in claim 9, where the spacer is opaque.

11. The package described in claim 8, where the panel is transparent.

12. The package described in claim 8, where said package also includes an insert displaced between the first side and the second side and where said electronic device is mounted on said insert.

13. The package described in claim 12, where the insert is made of cardboard.

* * * * *